US008915222B2

(12) United States Patent
Kobayashi et al.

(10) Patent No.: US 8,915,222 B2
(45) Date of Patent: Dec. 23, 2014

(54) VARIABLE VALVE TIMING CONTROL APPARATUS

(71) Applicant: Aisin Seiki Kabushiki Kaisha, Kariya-shi (JP)

(72) Inventors: Masaki Kobayashi, Okazaki (JP); Kenji Nonaka, Nagoya (JP); Yoshihiro Kawai, Obu (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 35 days.

(21) Appl. No.: 13/757,020

(22) Filed: Feb. 1, 2013

(65) Prior Publication Data

US 2013/0228142 A1 Sep. 5, 2013

(30) Foreign Application Priority Data

Mar. 2, 2012 (JP) ..... 2012-046507
Mar. 2, 2012 (JP) ..... 2012-046508
Nov. 2, 2012 (JP) ..... 2012-242535
Nov. 2, 2012 (JP) ..... 2012-242536

(51) Int. Cl.
*F01L 1/34* (2006.01)
*F01L 1/344* (2006.01)

(52) U.S. Cl.
CPC ..... *F01L 1/34* (2013.01); *F01L 1/3442* (2013.01); *F01L 2001/34463* (2013.01)
USPC ..... 123/90.17; 123/90.15

(58) Field of Classification Search
CPC .. F01L 1/3442; F01L 1/34; F01L 2001/34463
USPC ..... 123/90.15, 90.17, 90.31
See application file for complete search history.

(56) References Cited

U.S. PATENT DOCUMENTS 8,291,876 B2 * 10/2012 Patrick ..... 123/90.17
2011/0162603 A1 * 7/2011 Busse ..... 123/90.17

FOREIGN PATENT DOCUMENTS

JP 2011-256772 A 12/2011

* cited by examiner

*Primary Examiner* — Zelalem Eshete
(74) *Attorney, Agent, or Firm* — Buchanan Ingersoll & Rooney PC

(57) ABSTRACT

A variable valve timing control apparatus includes a driving side rotation member, a driven side rotation member positioned coaxially with a rotational axis of the driving side rotation member, at least one plate, a plurality of partition portions forming a fluid chamber between the partition portions, a vane portion being fitted to the fluid chamber to relatively rotate the driving side rotation member and the driven side rotation member within a movable range thereof, a restriction mechanism for restricting a relative rotational phase, a fastening member fixing the plate and the partition portion of the driving side rotation member, and a reinforcement member engaged with the partition portion including a contact surface among the partition portions, the contact surface being configured to receive a contact of the vane portion when the relative rotational phase is either at a most retarded angle phase or a most advanced angle phase.

12 Claims, 8 Drawing Sheets

VARIABLE VALVE TIMING CONTROL APPARATUS

CROSS REFERENCE TO RELATED APPLICATIONS

This application is based on and claims priority under 35 U.S.C. §119 to Japanese Patent Application 2012-242536, filed on Nov. 2, 2012, Japanese Patent Application 2012-242535, filed on Nov. 2, 2012, Japanese Patent Application 2012-046508, filed on Mar. 2, 2012, and Japanese Patent Application 2012-046507, filed on Mar. 2, 2012 the entire contents of which are incorporated herein by reference.

TECHNICAL FIELD

This disclosure generally relates to a variable valve timing control apparatus.

BACKGROUND DISCUSSION

A known variable valve timing control apparatus which restrains deviation, or fluctuation of a relative rotational phase when a vane portion of a driven side rotation member is in contact with a partition portion of a driving side rotation member is disclosed in JP2011-256772A (i.e., hereinafter referred to as Patent reference 1). According to the known variable valve timing control apparatus, the driven side rotation member (vane rotor) is housed in the driving side rotation member (housing), the driven side rotation member and the driving side rotation member are sandwiched by a cover and a sprocket which are formed in plates shape, and the driven side rotation member, the driving side rotation member, the cover, and the sprocket are fastened by bolts.

According to the construction disclosed in Patent reference 1, plural partition portions are formed on the driving side rotation member to inwardly protrude, and plural vane portions (vanes) formed on the driven side rotation member are fitted into the driving side rotation member between the plural partition portions. Thus, retarded angle chambers and advanced angle chambers are formed between partition portions and vane portions. By supplying an operation fluid to one of the retarded angle chamber and the advanced angle chamber, selectively, the driven side rotation member is relatively rotated.

According to the construction disclosed in Patent reference 1, a protruding portion which protrudes in a retarded angle direction is formed on one of the plural valve portions, and a protruding portion which protrudes in an advanced angle direction is formed on another one of the vane portions. According to the variable valve timing control apparatus disclosed in Patent reference 1, a limit of a relative rotational phase is defined by the contact of one of the protruding portions with a bolt when the relative rotational phase reaches a most retarded angle and by the contact of the other one of the protruding portions with a bolt when the relative rotational phase reaches a most advanced angle. According to the foregoing construction, a deviation or fluctuation of positional relationship between the driving side rotation member and the sprocket is restrained while avoiding a direct contact between the vane portion and the partition portion, thereby solving a drawback that the most retarded angle and the most advanced angle fluctuate from predetermined phases, respectively.

According to the construction which restrains a direct contact between the vane portion and the partition portion as disclosed in Patent reference 1, structures of the driving side rotation member and the driven side rotation member are complexified because a recessed portion which receives the protruding portion is formed on the partition portion. Further, with the construction in which the protruding portion comes in contact with the bolt, a contact portion of the bolt with which the protruding portion comes in contact may be deformed or may be worn away in a case the protruding portion repeatedly comes in contact with the bolt because the bolt is formed in a rod shape and a contact dimension relative to the protruding portion is relatively small, which may bring a drawback that a relative rotational phase of the most retarded angle or the most advanced angle is fluctuated from the predetermined phase.

The construction that the vane portion of the driven side rotation member comes in contact with the partition portion of the driving side rotation member for determining the position of the most retarded angle or the most advanced angle according to the known variable valve timing control apparatus is formed in a simple configuration and can be readily manufactured. However, the driving side rotation member and the driven side rotation member may move, or shift about a rotation center in a state where an operation fluid is not adequately supplied, for example, at a start of an internal combustion engine so that the partition portion and the vane portion contact hard repeatedly. In the case where the partition portion and the vane portion contact hard, the partition portion may be plastically deformed, for example, being buckled, alternatively, the partition portion may be immobilized while being elastically deformed by a fastening force which acts on the partition portion in an axial direction by a fastening member, which may deviate, or fluctuate a relative rotational phase of the most retarded angle or the most advanced angle from the predetermined relative rotational phase.

Thus, in a case where the relative rotational phase of the most retarded angle or the most advanced angle, which is determined by a contact of the vane portion to the partition portion, fluctuates, or deviates from the predetermined relative rotational phase, a control for the relative rotational phase with reference to the most retarded angle or the most advanced angle cannot be performed appropriately, accordingly, there remains room for improvement.

A need thus exists for a variable valve timing control apparatus which is not susceptible to the drawback mentioned above.

SUMMARY

In light of the foregoing, the disclosure provides a variable valve timing control apparatus, which includes a driving side rotation member synchronously rotating with a crankshaft of an internal combustion engine, a driven side rotation member positioned coaxially with a rotational axis of the driving side rotation member and synchronously rotating with a camshaft for opening and closing a valve for the internal combustion engine, at least one plate provided at a position facing at least one of surfaces of the driving side rotation member, the surfaces extending in a radial direction, a plurality of partition portions extending inwardly from an outer peripheral inner portion of the driving side rotation member to form a fluid chamber between the partition portions, a vane portion extending outwardly from an inner peripheral outer portion of the driven side rotation member, the vane portion being fitted to the fluid chamber to relatively rotate the driving side rotation member and the driven side rotation member within a movable range of the vane portion, a retarded angle chamber formed by dividing the fluid chamber by the vane portion and configured to vary a relative rotational phase of the driven side rotation member relative to the driving side rotation member towards a retarded angle side, an advanced angle chamber formed by dividing the fluid chamber by the vane portion and configured to vary the relative rotational phase of the driven side rotation member relative to the driving side rotation member towards an advanced angle side, a restriction mechanism for restricting the relative rotational phase, the restriction mechanism including a restriction member configured to switch a restricted position, which is defined as a position at which a relative rotation between the driving side rotation member and the driven side rotation member is restricted at the relative rotational phase except a most retarded angle phase and a most advanced angle phase, and an unrestricted position at which the restriction is canceled, a fastening member fixing the plate and the partition portion of the driving side rotation member, and a reinforcement member engaged with the partition portion including a contact surface among the partition portions, the contact surface being configured to receive a contact of the vane portion when the relative rotational phase is either at the most retarded angle phase or the most advanced angle phase.

According to another aspect of this disclosure, a variable valve timing control apparatus includes a driving side rotation member synchronously rotating with a crankshaft of an internal combustion engine, a driven side rotation member positioned coaxially with a rotational axis of the driving side rotation member and synchronously rotating with a camshaft for opening and closing a valve for the internal combustion engine, at least one plate provided at a position facing at least one of surfaces of the driving side rotation member, the surfaces extending in a radial direction, a plurality of partition portions extending inwardly from an outer peripheral inner portion of the driving side rotation member to form a fluid chamber between the partition portions, a vane portion extending outwardly from an inner peripheral outer portion of the driven side rotation member, the vane portion being fitted to the fluid chamber to relatively rotate the driving side rotation member and the driven side rotation member within a movable range of the vane portion, a retarded angle chamber formed by dividing the fluid chamber by the vane portion and configured to vary a relative rotational phase of the driven side rotation member relative to the driving side rotation member towards a retarded angle side, an advanced angle chamber formed by dividing the fluid chamber by the vane portion and configured to vary the relative rotational phase of the driven side rotation member relative to the driving side rotation member towards an advanced angle side, a restriction mechanism for restricting the relative rotational phase, the restriction mechanism including a restriction member configured to switch a restricted position, which is defined as a position at which a relative rotation between the driving side rotation member and the driven side rotation member is restricted at the relative rotational phase except a most retarded angle phase and a most advanced angle phase, and an unrestricted position at which the restriction is canceled, a fastening member fixing the plate and the partition portion of the driving side rotation member, and a protection member provided in at least one of the retarded angle chambers and in at least one of the advanced angle chambers, the protection member with which the vane portion comes in contact when the relative rotational phase is at the most retarded angle phase or at the most advanced angle phase.

According to a further aspect of this disclosure, a variable valve timing control apparatus includes a driving side rotation member synchronously rotating with a crankshaft of an internal combustion engine, a driven side rotation member positioned coaxially with a rotational axis of the driving side rotation member and synchronously rotating with a camshaft for opening and closing a valve for the internal combustion engine, a plate provided at a position facing at least one of surfaces of the driving side rotation member, the surfaces extending in a radial direction, a plurality of partition portions extending inwardly from an outer peripheral inner portion of the driving side rotation member to form a fluid chamber between the partition portions, a vane portion extending outwardly from an inner peripheral outer portion of the driven side rotation member, the vane portion being fitted to the fluid chamber to relatively rotate the driving side rotation member and the driven side rotation member within a movable range of the vane portion, a retarded angle chamber formed by dividing the fluid chamber by the vane portion and configured to vary a relative rotational phase of the driven side rotation member relative to the driving side rotation member towards a retarded angle side, an advanced angle chamber formed by dividing the fluid chamber by the vane portion and configured to vary the relative rotational phase of the driven side rotation member relative to the driving side rotation member towards an advanced angle side, a fastening member fixing the plate to the partition portion of the driving side rotation member, and a reinforcement member engaged with the partition portion including a contact surface among the partition portions, the contact surface being configured to receive a contact of the vane portion when the relative rotational phase is either at a most retarded angle phase or a most advanced angle phase, the reinforcement member being engaged with the partition portion at a position having a distance from the rotational axis which is shorter than a distance from the rotational axis to the fastening member.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments of a variable valve timing control apparatus will be explained with reference to illustrations of drawing figures as follows.

Figure 1:
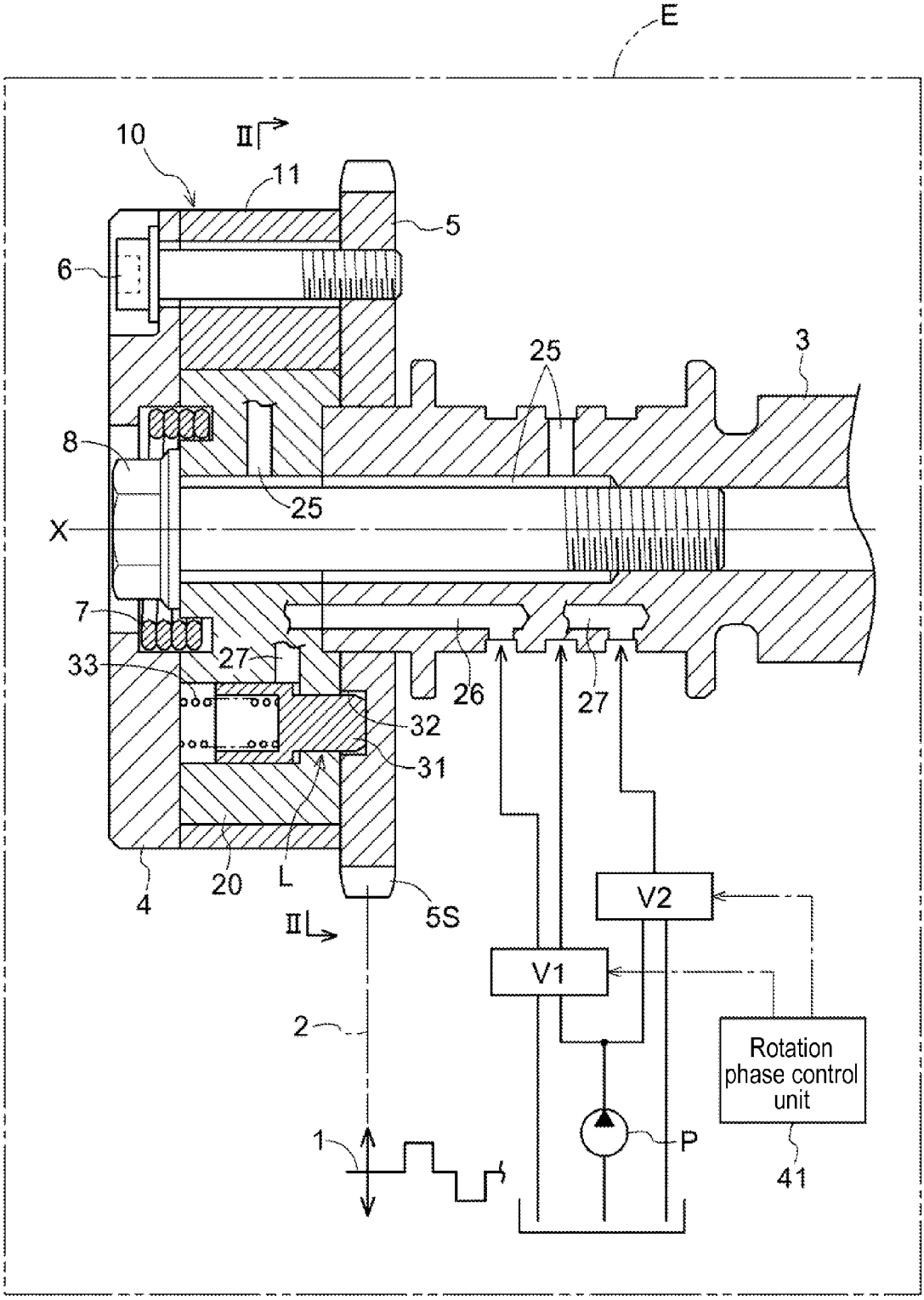
FIG. 1 is a longitudinal cross-sectional view of a variable valve timing control apparatus according to a first embodiment disclosed here.
Figure 2:
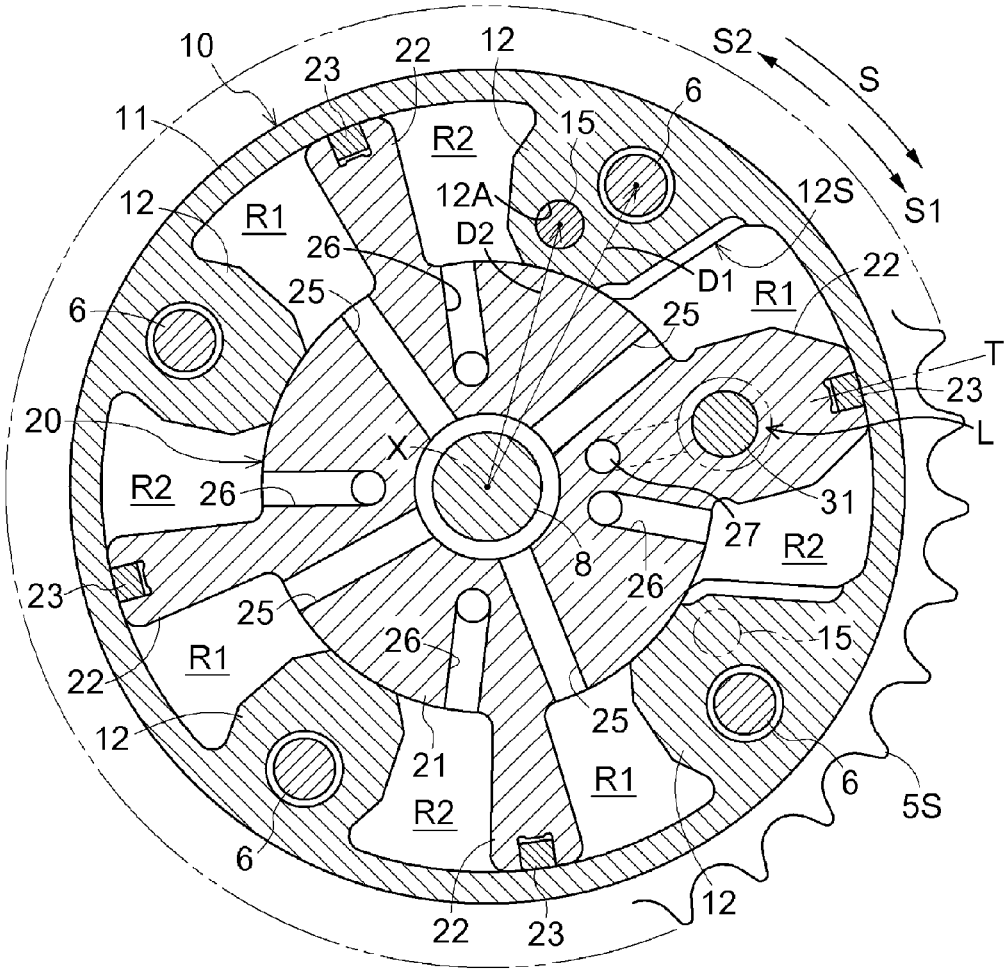
FIG. 2 is a cross-sectional view of the variable valve timing control apparatus taken along line II-II in FIG. 1.

A first embodiment of the variable valve timing control apparatus will be explained referring to FIGS. 1 to 4. As illustrated in FIGS. 1 and 2, the variable valve timing control apparatus includes an outer rotor 10 serving as a driving side rotation member, an inner rotor 20 serving as a driven side rotation member, and a lock mechanism L serving as a restriction mechanism for stopping, or restricting a relative rotation between the outer rotor 10 and the inner rotor 20. The outer rotor 10 synchronously rotates with a crankshaft 1 of an engine E serving as an internal combustion engine via a timing chain 2. The inner rotor 20 is connected to a camshaft 3 for opening and closing an intake valve at a combustion chamber of the engine E, and is positioned coaxially to a rotational axis X, which corresponds to an axis of the camshaft 3, of the outer rotor 10 so as to be relatively rotatable to the outer rotor 10. The lock mechanism L is configured to retain the outer rotor 10 and the inner rotor 20 at a predetermined relative rotational phase by stopping, or restricting a relative rotation of the outer rotor 10 and the inner rotor 20.

According to the variable valve timing control apparatus of the embodiment, by supplying an operation fluid (e.g., operation oil) by a rotation phase control valve V1 to a selected one of advanced angle chamber R1 and a retarded angle chamber R2 which are formed between the outer rotor 10 and the inner rotor 20, a relative rotational phase between the outer rotor 10 and the inner rotor 20 can be set at a certain position. By supplying the operation fluid from a lock control valve V2 to the lock mechanism L, the lock mechanism L is unlocked.

Solenoid valves are applied as the rotation phase control valve V1 and the lock control valve V2. The rotation phase control valve V1 and the lock control valve V2 are controlled by a control signal outputted from a rotation phase control unit 41 serving as an electric control unit (ECU). The rotation phase control unit 41 is also referred to as the phase control unit 41. The rotation phase control unit 41 is configured to set a targeted relative rotational phase on the basis of detection signals, for example, from a phase sensor detecting a relative rotational phase between the outer rotor 10 and the inner rotor 20, and a speed sensor detecting a rotation speed of the engine E, and thus outputting a control signal to the rotation phase control valve V1 and the lock control valve V2.

The relative rotational phase between the outer rotor 10 and the inner rotor 20 is varied by the foregoing controls to control an opening and closing timing of the intake valve, which is controlled by the rotation of the camshaft 3, and states of the lock mechanism L is changed to a locked state and to an unlocked state. Alternatively, the variable valve timing control apparatus may be configured to control not only an opening and closing timing of the intake valve but also an opening and closing timing of an exhaust valve.

The variable valve timing control apparatus includes a front plate 4 positioned at a front portion and a rear plate 5 which is positioned at an opposite side from the front plate 4 (i.e., closer to engine). The outer rotor 10 and the inner rotor 20 are sandwiched between the front plate 4 and the rear plate 5. A connection bolt 6, serving as a fastening member, is inserted into the outer rotor 10 from the front plate 4 to screw the front plate 4 and the rear plate 5 together to connect the front plate 4 and the rear plate 5 via the outer rotor 10.

A sprocket 5S around which the timing chain 2 is wounded is integrally formed on an outer periphery of the rear plate 5. A torsion spring 7, which biases the inner rotor 20 in an advanced angle direction S1, is provided between the front plate 4 and the inner rotor 20. A fixing bolt 8, which connects the inner rotor 20 to the camshaft 3 to be fixed, is positioned coaxially with the rotational axis X. A portion of an advanced angle passage 25 is formed at an outer periphery of the fixing bolt 8.

The outer rotor 10 is formed with plural partition portions 12 which extend, or protrude inwardly from an outer shell portion 11 serving as an outer periphery inner portion which is cylindrically formed. The inner rotor 20 is formed with plural vane portions 22 which extend, or protrude outwardly and radially from a body portion 21 serving as an inner periphery outer portion which is cylindrically formed. A fluid chamber (fluid void, e.g., oil chamber) is formed between the partition portions 12 of the outer rotor 10. The outer rotor 10 and the inner rotor 20 are positioned in the fluid chamber in a manner that the vane portions 22 are fitted into the fluid chamber. According to the foregoing positioning, the fluid chamber is partitioned by the vane portion 22 so that the advanced angle chamber R1 is formed at one side in the fluid chamber relative to the vane portion 22 and the retarded angle chamber R2 is formed at the other side in the fluid chamber relative to the vane portion 22. In those circumstances, the outer rotor 10 and the inner rotor 20 are relatively rotatable within an angle, or a range that the vane portion 22 is movable in the fluid chamber.

Figure 3:
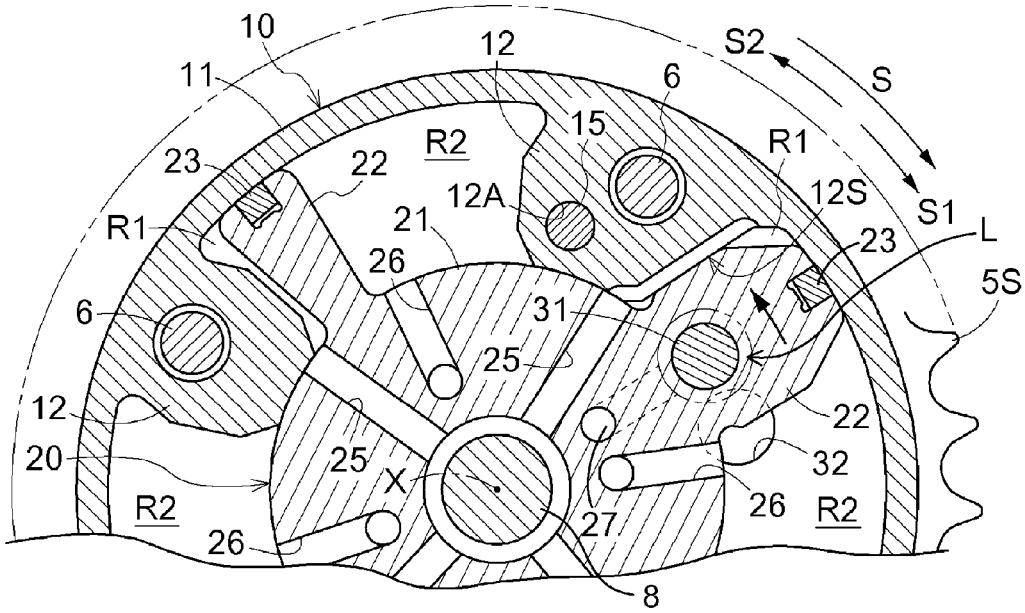
FIG. 3 is a partial cross-sectional view of the variable valve timing control apparatus in a state where a relative rotational phase is positioned at a most retarded angle according to the first embodiment disclosed here.

The outer rotor 10 is rotated by the timing chain 2 in a direction shown with S (rotation direction S) in FIG. 2. Upon the supply of the operation fluid in the advanced angle chamber R1, the relative rotational phase varies in an advanced angle direction S1. Upon the supply of the operation fluid in the retarded angle chamber R2, the relative rotational phase varies in a retarded angle direction S2. A seal 23 which is in contact with an inner peripheral surface of the outer shell portion 11 of the outer rotor 10 is formed on an protrusion end of the vane portion 22. As illustrated in FIG. 3, a contact surface 12S, which comes in contact with the vane portion 22 when the relative rotational phase is set at the most retarded angle, is formed at the partition portion 12. In a state where the partition portion 12 is in contact with the vane portion 22, a groove for supplying the operation fluid from the advanced angle passage 25 between the contact surface 12S and the vane portion 22 is formed.

A relative rotational phase at about a center between the most retarded angle and the most advanced angle is defined as an intermediate phase. The torsion spring 7 is configured to apply a biasing force until the relative rotational phase reaches the intermediate phase from a state where the relative rotational phase is at the most retarded angle (i.e., a biasing force exerted by the torsion spring 7 is defined in a range, or level which allows the torsion spring 7 to exert the biasing force from a state where the relative rotational phase is at the most retarded angle to a state where the relative rotational phase is at the intermediate phase). Alternatively, a range, or level of the biasing force that the torsion spring 7 exerts may be defined to be a degree that the relative rotational phase exceeds the intermediate phase (i.e., closer to the most advanced angle). Further, alternatively, a range, or level of the biasing force that the torsion spring 7 exerts may be defined to be a degree that the relative rotational phase fall short of the intermediate phase (i.e., closer to the most retarded angle).

The variable valve timing control apparatus according to the embodiment includes the advanced angle passage 25, a retarded angle passage 26, and a lock release fluid passage 27 which are formed on the inner rotor 20. The advanced angle passage 25 is in communication with the advanced angle chamber R1. The retarded angle passage 26 is in communication with the retarded angle chamber R2. The lock release fluid passage 27 is configured to unlock the lock mechanism L. The advanced angle passage 25, the retarded angle passage 26, and the lock release fluid passage 27 are in communication with a passage inside the camshaft 3, and are connected to the rotation phase control valve V1 and the lock control valve V2 via an outer peripheral surface of the camshaft 3. A hydraulic pressure pump P for supplying the operation fluid to the rotation phase control valve V1 and the lock control valve V2 is actuated by the engine E.

Construction of the lock mechanism L will be explained in detail hereinafter. The lock mechanism L includes a lock pin 31 serving as a restriction member, a fitting recess portion 32, and a lock spring 33. The lock pin 31 is provided at one of the vane portions 22 formed on the inner rotor 20 to be retractable (i.e., to protrude and retract) along an axis which is in parallel with the rotational axis X. The fitting recess portion 32 is formed on the rear plate 5 to receive the lock pin 31. The lock spring 33 is configured to bias the lock pin 31 in an engaging direction, or in a protruding direction.

The positioning of the fitting recess portion 32 is determined so that lock mechanism L is assumed to be a locked state (i.e., restricted) at an intermediate lock phase T serving as a restriction position. The intermediate lock phase T is defined at a phase where the engine E operates efficiently and effectively with favorable fuel economy among the intermediate phase of the relative rotational phase at a center between the most retarded angle and the most advanced angle. The rotation phase control unit 41 executes a control for establishing the locked state of the lock mechanism L by changing the relative rotational phase to the intermediate lock phase T when performing a stop control of the engine E. The lock release fluid passage 27 is connected to the lock pin 31 and the rotation phase control unit 41 controls the lock control valve V2 to supply the operation fluid to the lock release fluid passage 27 when releasing the locked state. According to the foregoing control, the lock pin 31 is retracted from the fitting recess portion 32, thus releasing the locked state (i.e., unlocking).

The positioning of the intermediate lock phase T is not limited to a phase where the relative rotational phase is positioned at a center position between the most retarded angle and the most advanced angle. Alternatively, the intermediate lock phase T may be set at a range closer to the most retarded angle relative to the center position or closer to the most advanced angle relative to the center position.

Constructions of a reinforcement member 15 will be explained in detail hereinafter. As one of a control modes performed by the rotation phase control unit 41 according to the variable valve timing control apparatus of the embodiment, the relative rotational phase is set at the most retarded angle by contacting the vane portion 22 to the contact surface 12S of the partition portion 12 when cranking the engine E, and a sequence, for example, starting an ignition in the combustion chamber after the operation fluid is supplied for a predetermined time is provided.

When executing the control under the foregoing control mode, the operation fluid is supplied from the hydraulic pressure pump P to the lock release fluid passage 27 to release the locked state of the lock mechanism L to vary the relative rotational phase in the retarded angle direction by controlling the supply of the operation fluid to the retarded angle chamber R2. However, there is a possibility that the hydraulic pressure adequate for changing the relative rotational phase cannot be supplied to the advanced angle chamber R1 depending on a timing that the locked state of the lock mechanism L is released, or canceled. In a case where the engine E is stopped in a state where the lock mechanism L is not locked (i.e., fail state, for example, engine stall), the hydraulic pressure necessary for establishing the locked state of the lock mechanism L cannot be supplied at an initial stage when restarting the engine E. In those circumstances, the inner rotor 20 moves largely about the rotational axis X by a reactive force in response to a rotation of the camshaft 3, the vane portion 22 repeatedly contacts the contact surface 12S of the partition portion 12 hard, which may deform a protrusion end of the partition portion 12 in a retarded angle direction S2.

Figure 4:
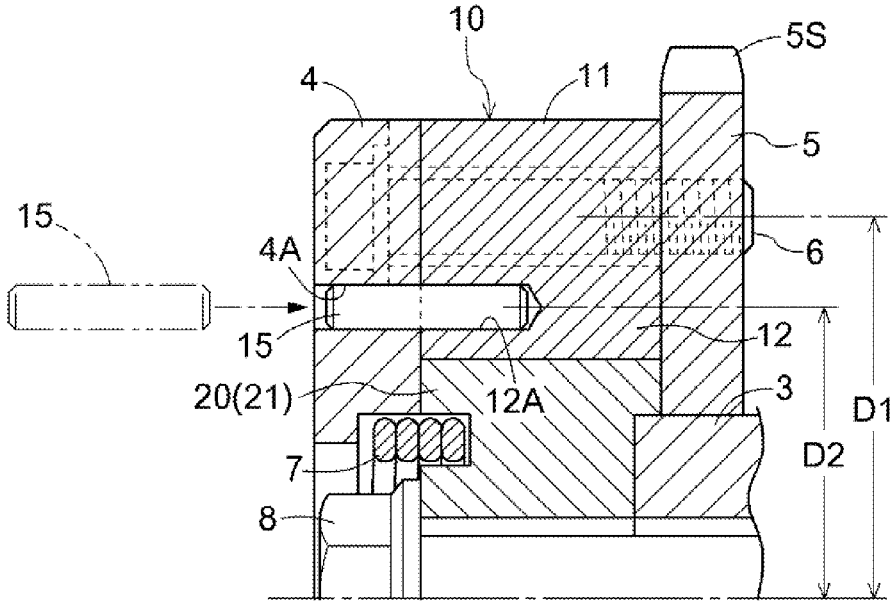
FIG. 4 is a partial cross-sectional view of the variable valve timing control apparatus particularly showing a reinforcement member.

In order to prevent the deformation, as illustrated in FIGS. 2 and 4, the reinforcement member 15 is configured in a pin shape (e.g., dowel pin) to engage with the front plate 4 and the partition portion 12. That is, an engagement hole 12A which is arranged in parallel with the rotational axis X is formed on the partition portion 12 at an engagement position which is defined by a distance D2 from the rotational axis X. The distance D2 is defined to be shorter than a distance D1 from the rotational axis X1 to the connection bolt 6. Further, an engagement hole 4A which is arranged in parallel with the rotational axis X at a position corresponding to the engagement hole 12A is formed. The partition portion 12 and the front plate 4 are integrally formed by providing the reinforcement member 15 extending over the engagement hole 12A and the engagement hole 4A. The reinforcement member 15 is provided (driven, or hammered) within the engagement hole 4A and the engagement hole 12A to tightly fit therewith to be retained.

Accordingly, because the reinforcement member 15 is engaged extending over the front plate 4 and a portion in the vicinity of the protrusion end of the partition portion 12 of the outer rotor 10 serving as the driving side rotation member, even if the vane portion 22 repeatedly contacts the contact surface 12S of the partition portion 12 hard, the force acting on the partition portion 12 is received by the front plate 4 via the reinforcement member 15 (i.e., the force acting on the partition portion 12 is transmitted to the front plate 4 via the reinforcement member 15), thus the deformation of the partition portion 12 is restrained.

Figure 5:
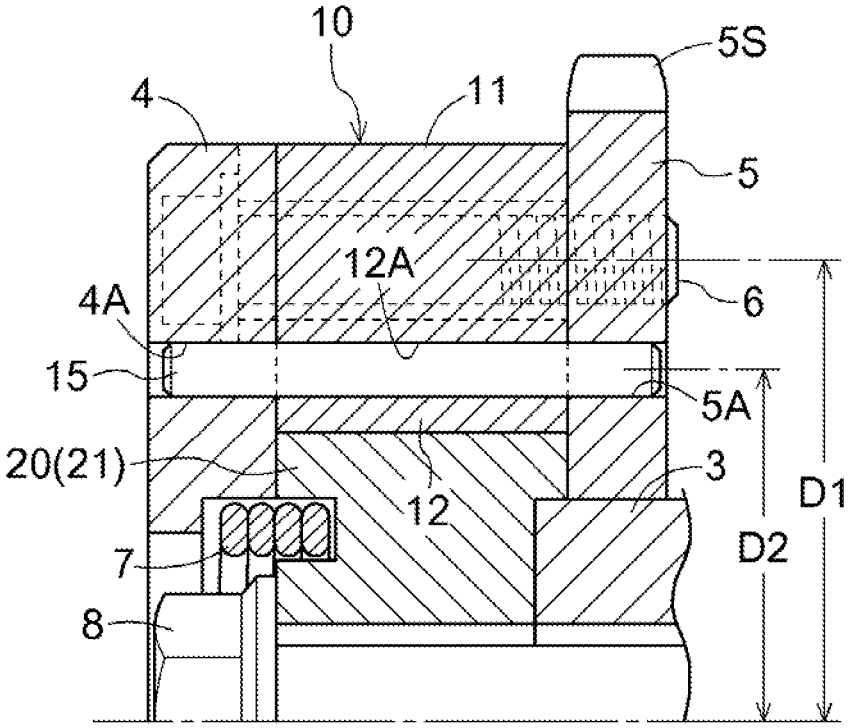
FIG. 5 is a partial cross-sectional view of a variable valve timing control apparatus particularly showing another example of a reinforcement member according to a modified example of the first embodiment.

A first modified example of the reinforcement member 15 according to the embodiment will be explained as follows. According to the embodiment, the engagement of the reinforcement member 15 is not limited to a configuration that the reinforcement member 15 is engaged with the front plate 14 and the partition portion 12. Alternatively, as illustrated in FIG. 5, the reinforcement member 15 may be engaged with the front plate 4, the partition portion 12, and the rear plate 5.

That is, the engagement hole 12A which is arranged in parallel with the rotational axis X is formed on the partition portion 12 at the engagement position which is defined by the distance D2 from the rotational axis X. The distance D2 is defined to be shorter than the distance D1 from the rotational axis X1 to the connection bolt 6. Further, the engagement hole 4A and an engagement hole 5A, which are arranged in parallel with the rotational axis X at positions corresponding to the engagement hole 12A, are formed. The front plate 4, the partition portion 12, and the rear plate 5 are integrally formed by providing (driving, hammering) the reinforcement member 15 spanning over, or extending over the engagement hole 4A, the engagement hole 12A, and the engagement hole 5A.

Accordingly, because the reinforcement member 15 is engaged with the front plate 4, the rear plate 5, and a portion in the vicinity of the protrusion end of the partition portion 12 of the outer rotor 10 serving as the driving side rotation member, even if the vane portion 22 repeatedly contacts the contact surface 12S of the partition portion 12 hard, the force acting on the partition portion 12 is received by the front plate 4 and the rear plate 5 via the reinforcement member 15 (i.e., the force acting on the partition portion 12 is transmitted to the front plate 4 and the rear plate 5 via the reinforcement member 15), thus the deformation of the partition portion 12 is restrained.

Particularly, according to the construction of the modified example of the embodiment, by the repetitive hard contact of the vane portion 22 to the contact surface 12S of the partition portion 12, even in a state where the positional relationship between the outer rotor 10 and the rear plate 5 changes, the reinforcement member 15 restricts, or restrains the relative positional displacement of the outer rotor 10 and the rear plate 5. That is, according to the construction in which the rear plate 5 is connected to the partition portion 12 by means of the connection bolt 6, a relative positional displacement (deviation) of the outer rotor 10 and the rear plate 5 is allowed by a degree of clearance formed between the hole portion formed on the partition portion 12 and an outer periphery of the connection bolt 6. An occurrence of the relative positional displacement of the outer rotor 10 and the rear plate 5 brings a drawback that a relative rotational phase between the sprocket 5S and the outer rotor 10 changes (deviates), however, according to the construction of the embodiment, the reinforcement member 15 prevents the relative positional displacement between the partition portion 12 and the rear plate 5 to retain a relative rotational phase in which the contact surface 12S and the vane portion 22 are in contact with each other at a predetermined phase to maintain a control with high precision.

Other modified examples of the reinforcement member will be explained as follows. According to a second modified example, the engagement hole 12A is formed at an engagement position of the partition portion 12 similar to the engagement position disclosed in the first embodiment, the engagement hole 5A is formed on the rear plate 5 at a position corresponding to the engagement hole 12A, and the reinforcement member 15 is provided to engage with the engagement hole 12A and the engagement hole 5A. Thus, with the construction that the reinforcement member 15 is provided spanning over, or extending over the rear plate 5 and the partition portion 12, the deformation of the partition portion 12 can be restrained.

According to a third modified example, similar to the first embodiment, the reinforcement member 15 is provided at the partition portion 12 at a position which receives a contact of the vane portion 22 when the vane portion 22 reaches the most advanced angle. More particularly, the reinforcement member 15 is provided at a position indicated with an imaginary line in FIG. 2. According to the foregoing construction, the deformation of the partition portion 12 when the vane portion 22 moves (shifts, or varies position) towards the most advanced angle and the vane portion 22 contacts the partition portion 12 can be restrained.

According to a fourth modified example, the engagement hole 12A is formed at the engagement position of the plural (i.e., two or more) partition portions 12, an engagement hole is formed at least one of the front plate 4 and the rear plate 5 at a position corresponding to the engagement hole 12A, and the reinforcement member 15 is provided to engage with the engagement hole 12A and the engagement hole formed at least one of the front plate 4 and the rear plate 5. According to the foregoing construction, the deformation of the partition portion 12 can be restrained.

According to a fifth modified example, the reinforcement member 15 which is threaded (e.g., similar to a stud bolt) and is configured to engage with the partition portion 12 at an engagement position similar to the first embodiment is provided. The reinforcement member 15 is engaged with the front plate 4 and/or the rear plate 5. Similarly, alternatively, the reinforcement member 15 which is threaded (e.g., similar to a stud bolt), is engaged with the front plate 4 and/or the rear plate 5, and is engaged with the engagement hole 12A formed at the engagement position of the partition portion 12. According to the foregoing construction, the reinforcement member 15 is prevented from falling off and continuous engagement is ensured.

According to a sixth modified example, by integrally forming a front plate or a rear plate as the outer rotor 10, one end of the outer rotor 10 has an opening. According to the foregoing construction, the plate is provided at a position for closing the opening, and the reinforcement member 15 is provided to be engaged with the partition portion 12 and the plate. According to the foregoing construction, the deformation of the partition portion 12 is restrained.

Effects and advantages of the first embodiment and modified examples are as follows. According to the constructions of the embodiment, even if the vane portion 22 repeatedly contacts the contact surface 12S of the partition portion 12 hard, for example, when starting the engine E, the deformation of the partition portion 12 is restrained by the reinforcement member 15. Accordingly, even in a case where the relative rotational phase is positioned at the most retarded angle and the variable valve timing control apparatus controls the relative rotational phase to shift to a targeted phase having the most retarded angle as a reference thereafter, fluctuations of the most retarded angle position which serves as the reference can be restrained, and thus the control with high precision can be achieved for a long term. Similarly, in a case where the relative rotational phase is positioned at the most advanced angle and the variable valve timing control apparatus controls the relative rotational phase to shift to a targeted phase having the most advanced angle as a reference thereafter, fluctuations of the most advanced angle position which serves as the reference can be restrained, and thus the control with high precision can be achieved for a long term.

Further, according to the first embodiment and the modified examples, using the known construction of the variable valve timing control apparatus, by a simple changes that providing the reinforcement member 15, e.g., a dowel pin, to engage with the inside of the partition portion 12 of the outer rotor 10 and the front plate 4 or the rear plate 5, the deformation of the partition portion 12 is restrained to continue the control with high precision.

A second embodiment of the variable valve timing control apparatus will be explained with reference to FIGS. 6 to 8 as follows. In place of the reinforcement member 15 provided at the partition portion 12 in the first embodiment, a protection member 91 is provided at a fluid chamber (fluid void)(e.g., oil chamber) formed between the partition portions 12. Basic constructions of the variable valve timing control apparatus and the lock mechanism L of the second embodiment are similar to the constructions of the first embodiment. Thus, differences from the first embodiment will be mainly explained and the explanations for the same construction with the first embodiment will not be repeated.

Figure 6:
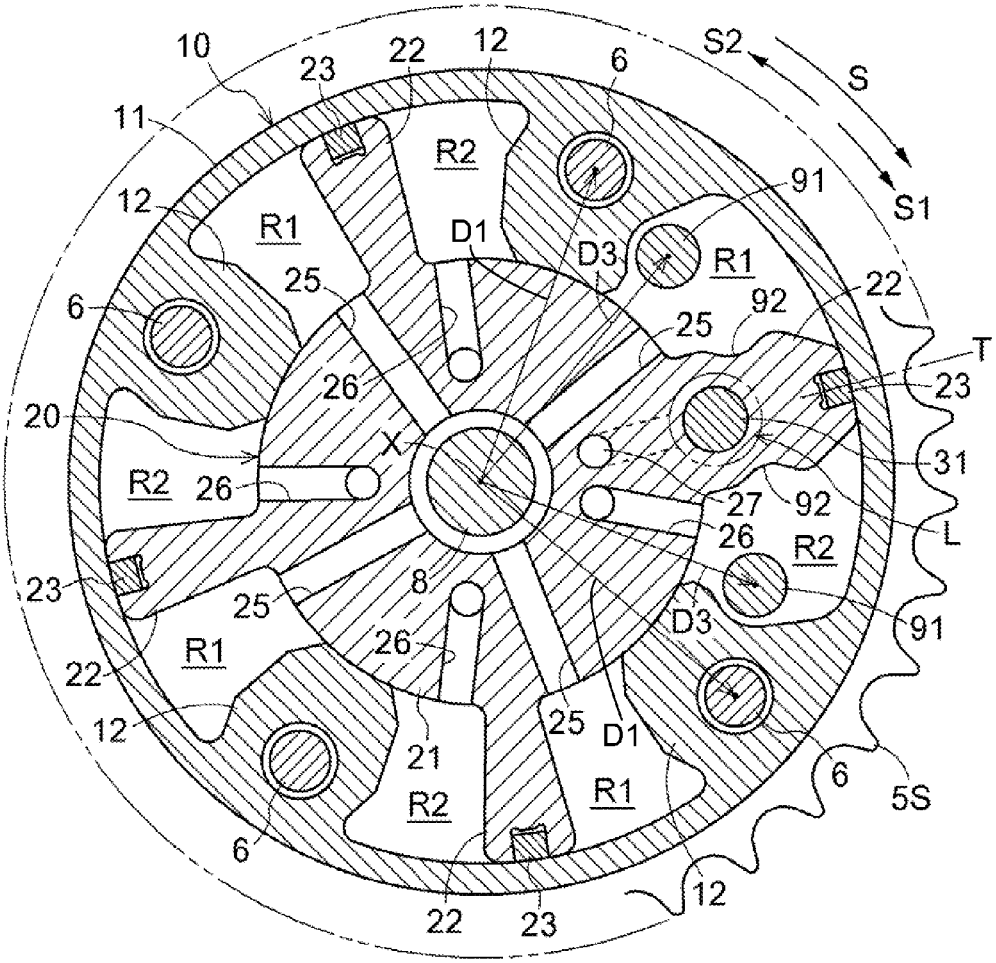
FIG. 6 is a cross-sectional view of a variable valve timing control apparatus in an axial direction according to a second embodiment disclosed here.
Figure 7:
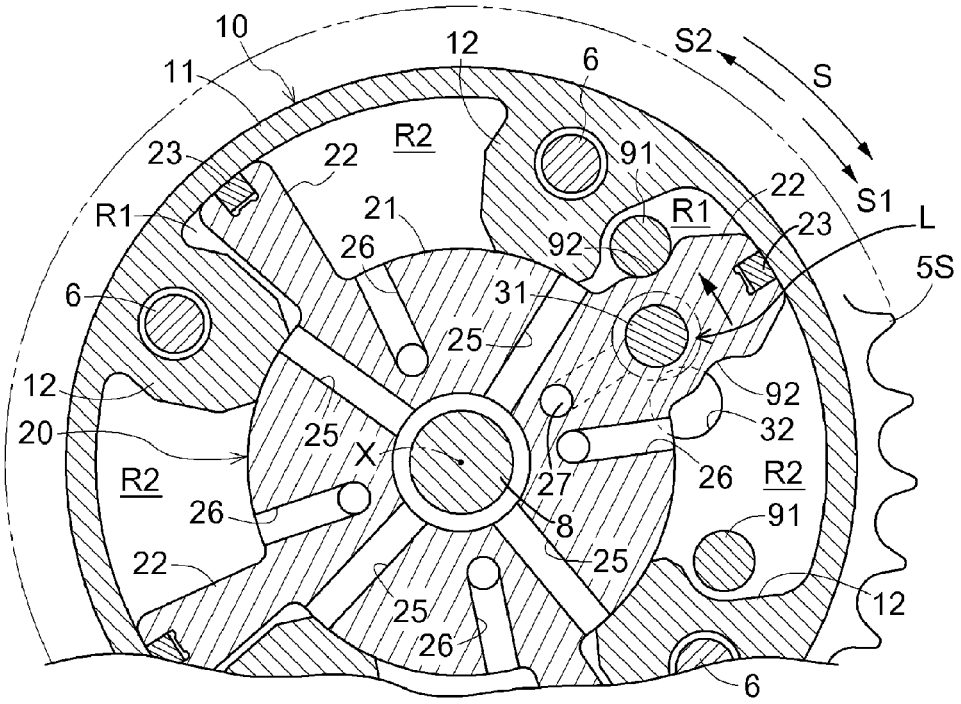
FIG. 7 is a partial cross-sectional view of a variable valve timing control apparatus in a state where a relative rotational phase is positioned at a most retarded angle according to the second embodiment disclosed here.

As illustrated in FIG. 6, similar to the first embodiment, plural fluid chambers (fluid void)(e.g., oil chamber) are formed between the partition portions 12. Each of the fluid chambers is separated by the vane portion 22 to form an advanced angle chamber R1 and a retarded angle chamber R2. The advanced angle chamber R1 and the retarded angle chamber R2 serve as a pair. Thus, plural pairs of the advanced angle chamber R1 and the retarded angle chamber R2 are provided depending on the number of the fluid chamber as shown in FIG. 6.

According to the second embodiment, the protection member 91 is provided at at least one of the retarded angle chambers R2 and at at least one of the advanced angle chambers R1 among the plural advanced angle chambers R1 and the retarded angle chambers R2. Particularly, according to the second embodiment, as illustrated in FIG. 6, the protection members 91 serving as a pair are positioned in the fluid chamber divided by the vane portion 22. The protection members 91 are positioned at opposite sides from each other relative to the vane portion 22.

Each of the protection members 91 is arranged at a position having a shorter distance from the rotational axis X compared to the distance from the rotational axis X to the connection bolt 6 so that the vane portion 22 comes in contact with the protection members 91 serving as a pair when the relative rotational phase is at the most retarded angle phase and the most advanced angle phase, respectively. That is, the protection member 91 provided in the advanced angle chamber R1 is positioned at the position, which has a shorter distance from the rotational axis X compared to the distance from the rotational axis X to the connection bolt 6, and the circumferential position of the protection member 91 is defined at a position where the vane portion 22 contacts when the relative rotational phase is at the most retarded angle phase as shown in FIG. 7. In those circumstances, the rotational axis X is a rotation center of the outer rotor 10 and the connection bolt 6 is a bolt which is inserted into the outer rotor 10 via the front plate 4 to be positioned through the front plate 4, the outer rotor 10, and the rear plate 5 and to threadedly engage with the rear plate 5. Thus, the protection member 91 provided in the advanced angle chamber R1 is provided at a radial position having a distance D3 from the rotational axis X which is shorter than the distance D1, serving as a reference, from the rotational axis X to the connection bolt 6. The circumferential position of the protection member 91 in those circumstances is provided at a position at which the vane portion 22 contacts the protection member 91 in a case where the relative rotational phase of the outer rotor 10 and the inner rotor 20 is assumed to be the most retarded angle phase when the operation fluid is supplied to the retarded angle chamber R2. According to the foregoing construction, interference between the connection bolt 6 and the protection member 91 in a circumferential direction can be restrained. Thus, because a circumferential length of the fluid chamber can be elongated as much as possible, a displacement angle of the relative rotational phase can be set to be greater.

Figure 8:
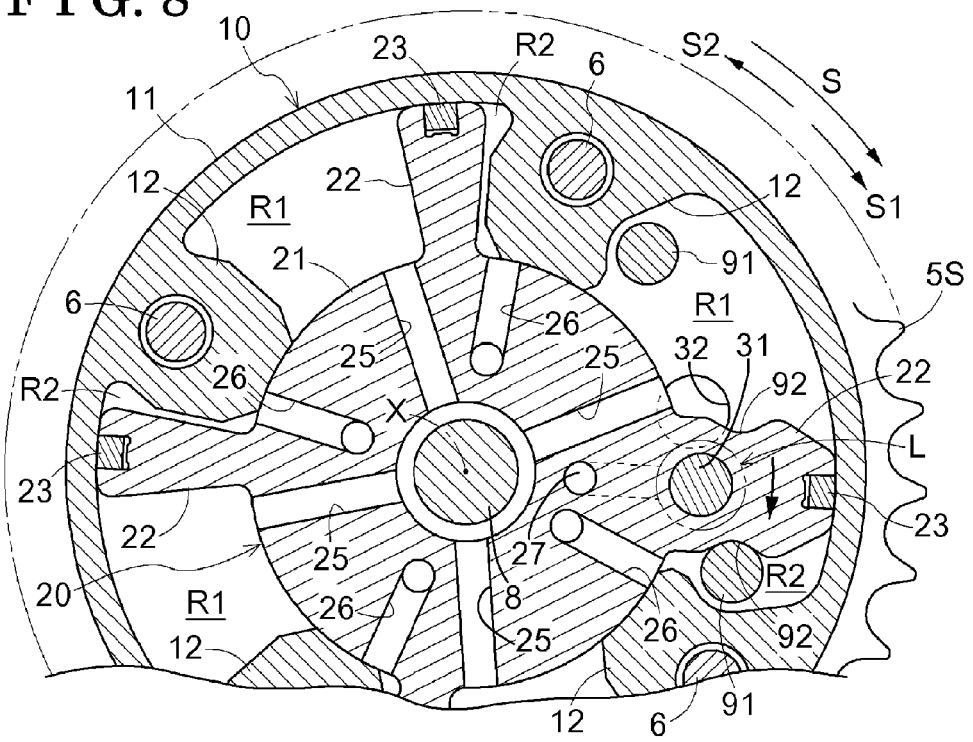
FIG. 8 is a partial cross-sectional view of the variable valve timing control apparatus in a state where the relative rotational phase is positioned at a most advanced angle according to the second embodiment disclosed here.

Similarly, the protection member 91 provided in the retarded angle chamber R2 is provided at a radial position whose distance from the rotational axis X is shorter than a distance from the rotational axis X to the connection bolt 6 and is provided at a circumferential position at which the vane portion 22 contacts when the relative rotational phase is at the most advanced angle phase as shown in FIG. 8. That is, the protection member 91 provided in the retarded angle chamber R2 is positioned at the radial position having a distance D3 from the rotational axis X, the distance D3 shorter than the distance D1, serving as a reference, from the rotational axis X to the connection bolt 6. Further, the position in the circumferential direction (circumferential position) in those circumstances is provided at the position at which the vane portion 22 contacts the protection member 91 in a case where the relative rotational phase of the outer rotor 10 and the inner rotor 20 is the most advanced angle phase. Accordingly, the motion of the vane portion 22 can be regulated between the most retarded angle phase and the most advanced angle phase.

According to the second embodiment, the protection member 91 is formed in a columnar shape whose axis is arranged in parallel with the rotational axis X of the outer rotor 10. The protection members 91 penetrates through the advanced angle chamber R1 and the retarded angle chamber R2, respectively, in parallel with the axial direction of the rotational axis X to engage with the front plate 4 and the rear plate 5 (to engage with and extend over the front plate 4 and the rear plate 5).

A surface of the vane portion 22 which faces, or come to face the protection member 91 includes a curvature which is smaller than a curvature of an outer peripheral surface of the protection member 91. An arced portion 92 which is configured to receive at least a part of the protection member 91 is formed at the surface of the vane portion 22 which faces, or come to face the protection member 91. The surface of the vane portion 22 which faces, or come to face the protection member 91 is a surface which is positioned at a side which comes in contact with the protection member 91 in accordance with the rotation of the vane portion 22, and further a hydraulic pressure acts on to the surface of the vane portion 22 in a case where the operation fluid is supplied to either the advanced angle chamber R1 or the retarded angle chamber R2.

The curvature of the outer peripheral surface of the protection member 91 is an indicator which shows a degree of the curve of the arc that the outer peripheral surface of the protection member 91 forms. The curvature corresponds to a value defined by a reciprocal (inverse number) of radius of the protection member 91. On the other hand, the arced portion 92 is formed at the surface of the vane portion 22 which faces the protection member 91. The arced portion 92 includes a configuration corresponding to a part of an arc. The arced portion 92 is formed to have a curvature which is smaller than the curvature of the outer peripheral portion of the protection member 91. That is, a radius of a circle which includes the arced portion 92 as a part of the arc is formed to be greater than a radius of the protection member 91.

The arced portion 92 is formed on the vane portion 22 extending over an entire length in the rotational axis direction. Thus, the protection member 91 and the arced portion 92 are arranged so that the axes are in parallel with each other. Further, the arced portion 92 is formed at surfaces of the vane portion 22 which is at an advanced angle direction S1 side and at a retarded angle direction S2 side. The arced portions 92 are formed to be recessed relative to the advanced angle direction S1 and the retarded angle direction S2, respectively. Thus, in a case where the vane portion 22 rotates in the retarded angle direction S2, a part of the protection member 91 which is positioned in the advanced angle chamber R1, as shown in FIG. 7, is accommodated in the arced portion 92 which faces (is directed to) the retarded angle direction S2 of the vane portion 22. On the other hand, in a case where the vane portion 22 rotates in the advanced angle direction S1, a part of the protection member 91 which is positioned in the retarded angle chamber R2, as shown in FIG. 8, is accommodated in the arced portion 92 which faces (is directed to) the advanced angle direction S1 of the vane portion 22.

Because the foregoing construction allows the vane portion 22 to rotate to the position at which the part of the protection member 91 is accommodated at the vane portion 22, a greater rotation range of the vane portion 22 can be ensured. Further, according to the foregoing construction, the volume of the operation fluid reserved (remained) at an end portion of the fluid chamber can be reduced in a case where the vane portion 22 is at the most advanced angle position or at the most retarded angle position. Accordingly, the responsivity can be enhanced.

A modified example of the second embodiment will be explained as follows. According to the second embodiment, as illustrated in FIG. 7, when the relative rotational phase is assumed to be the most retarded angle phase, a portion of the fluid chamber remains (is maintained) around the protection member 91 at the advanced chamber R1, particularly, at a radially outward position relative to the protection member 91 with reference to the rotational axis X. Further, as illustrated in FIG. 8, when the relative rotational phase is assumed to be the most advanced angle phase, a portion of the fluid chamber remains (is maintained) around the protection member 91 at the retarded angle chamber R2, particularly, at a radially outward position relative to the protection member 91 with reference to the rotational axis X.

Figure 9:
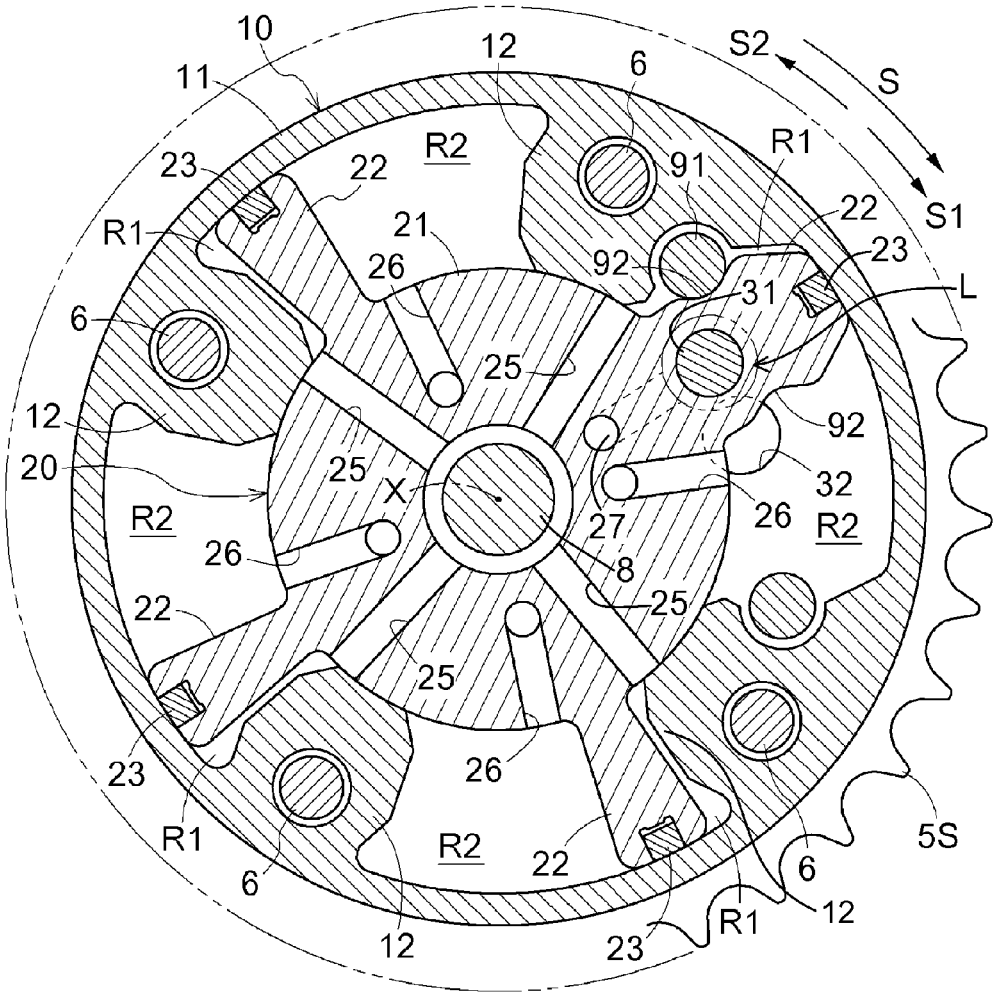
FIG. 9 is a partial cross-sectional view of a variable valve timing control apparatus according to a first modified example of the second embodiment.

As described above, the responsivity can be enhanced with the construction of the second embodiment. According to the modified example of the second embodiment, in order to further enhance the responsivity when staring the engine operation, it is favorable to reduce the volume of the fluid chamber remained (maintained) when the outer rotor 10 and the inner rotor 20 relatively rotate so that the relative rotational phase is changed from the most advanced angle phase towards the retarded angle direction S2 and when the outer rotor 10 and the inner rotor 20 relatively rotate so that the relative rotational phase is changed from the most retarded angle phase towards the advanced angle direction S1. As illustrated in FIG. 9, according to the modified example of the second embodiment, a portion of the partition portion 12 which is positioned at radially outward relative to the protection member 91 at the advanced angle chamber R1 and a portion of the partition portion 12 which is positioned at radially outward relative to the protection member 91 at the retarded angle chamber R2 with reference to the rotation axis X are protruded towards the vane portion 22 along a configuration of the vane portion 22. Thus, the volume of the retarded angle chamber R2 remained (maintained) when the relative rotational phase is at the most advanced angle phase and the volume of the advanced angle chamber R1 remained (maintained) when the relative rotational phase is at the most retarded angle phase can be reduced relative to the example shown in FIG. 6. Accordingly, because a time required for filling the operation fluid in the retarded angle chamber R2 in a state where the relative rotational phase is at the most advanced angle phase and a time required for filling the operation fluid in the advanced angle chamber R1 in a state where the relative rotational phase is at the most retarded angle phase can be shortened, the responsivity particularly when starting the engine operation can be enhanced.

Figure 10:
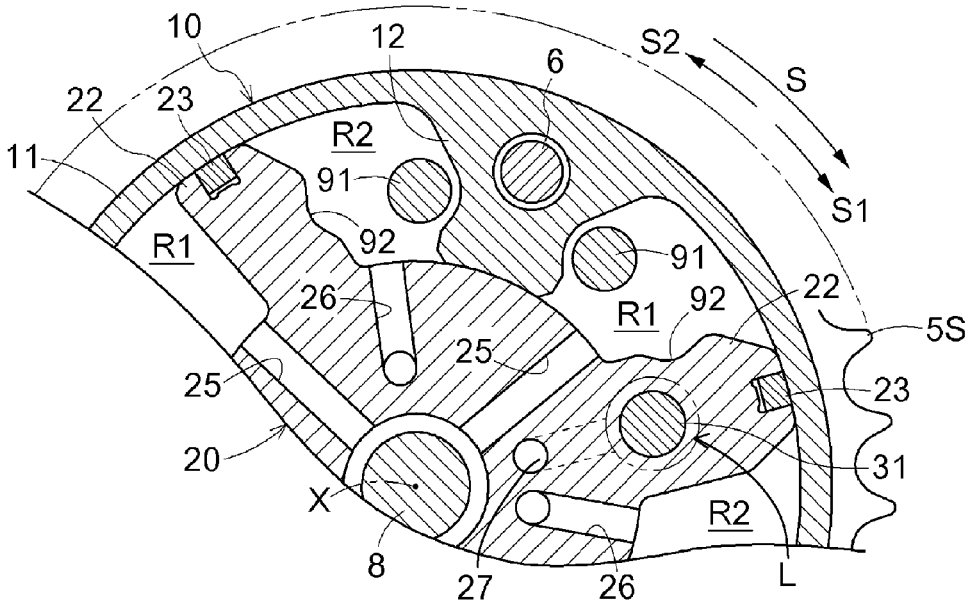
FIG. 10 is a partial cross-sectional view of a variable valve timing control apparatus according to a second modified example of the second embodiment.

Further, according to the second embodiment, the protection members 91 serving as a pair are provided in the same fluid chamber. Alternatively, the protection members 91 serving as a pair may be provided in separate chambers, for example, as illustrated in FIG. 10. In those circumstances, the protection members 91 serving as a pair are positioned sandwiching one of the partition portions 12. Thus, it is favorable that the arced portion 92 is formed at a surface of the vane portion 22 only at the side facing the corresponding protection member 91. According to the foregoing construction, the relative rotational phase can be appropriately regulated between the most advanced angle phase and the most retarded angle phase.

Figure 11:
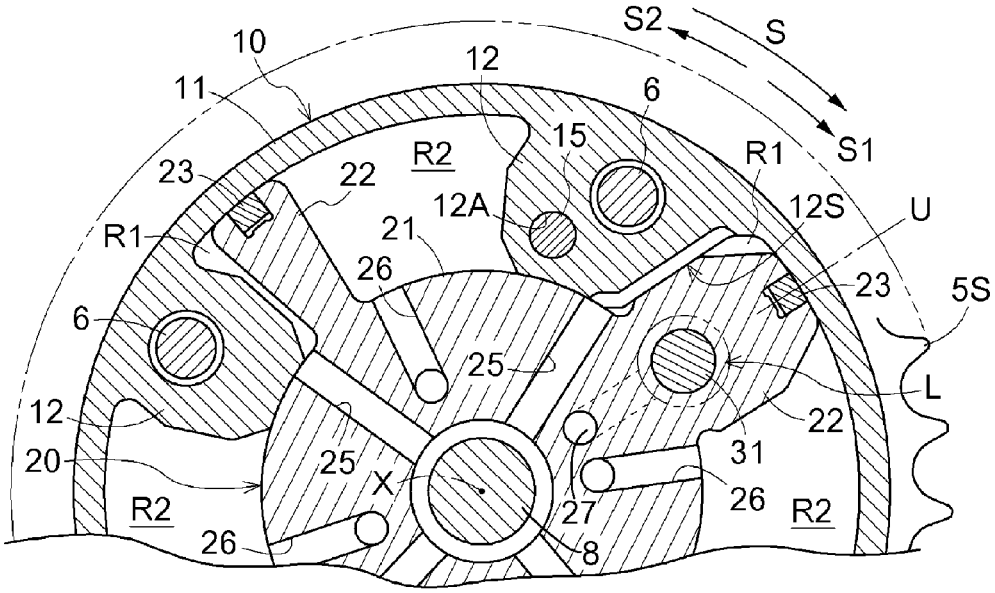
FIG. 11 is a partial cross-sectional view of a variable valve timing control apparatus according to another modified example.

As illustrated in FIG. 11, a rotational phase at which a relative rotational angle is positioned at the most retarded angle is set as a most retarded angle lock phase U which corresponds to a relative rotational phase at which the lock mechanism L is assumed to be in a locked state. According to the construction in which the variable valve timing control apparatus controls an intake valve by setting the most retarded angle lock phase U, a load applied to an intake system when starting the engine E is reduced thus to reduce pumping losses. In the most retarded angle lock phase U, the vane portion 22 may be positioned at a rotational phase at which the vane portion 22 is in contact with the partition portion 12 or at a rotational phase at which the vane portion 22 is detached from (is slightly away from) the partition portion 12.

Other modified examples of the embodiments will be explained as follows.

First, a lock member serving as a lock mechanism L may be provided at one of the outer rotor 10 and the inner rotor 20 so as to protrude and retract in a radial direction, a lock recess portion is formed at the position corresponding to the lock mechanism L, and a locked state may be established by inserting the lock member into and engaging the lock member with the lock recess portion (by engageably inserting the lock member into the lock recess portion).

Second, instead of providing the reinforcement member 15 at a protruding side of the partition portion 12 relative to the connection bolt 6, the reinforcement member 15 may be provided at a position having a distance from the rotational axis X equal to the distance from the rotational axis X to the connection bolt 6 so as to be arranged in parallel with the connection bolt 16.

According to the embodiments, the variable valve timing control apparatus includes the outer rotor 10, the front plate 4, and the rear plate 5. Alternatively, third, the outer rotor 10 may include a cup shape by integrally forming the outer rotor 10 and the front plate 4. In those circumstances, the lock pin 31 may be engaged with the rear plate 5 and the partition portion 12, or, the lock pin 31 may be engaged with a bottom portion of the cup shaped outer rotor 10 and the partition portion 12. Similarly, the outer rotor 10 may include a cup shape by integrally forming the outer rotor 10 and the rear plate 5. In those circumstances, the lock pin 31 may be constructed similar to the foregoing construction.

Fourth, instead of providing the protection members 91 serving as a pair, the protection member 91 may be provided in every fluid chamber. Further, alternatively, the number of the protection members 91 provided in the advanced angle chambers R1 may differ from the number of the protection members 91 provided in the retarded angle chambers R2.

Fifth, instead of forming the arced portion 92 at the vane portion 22, the arced portion 92 may not be provided at the vane portion 22. Further, alternatively, instead of columnar shape, the protection member 91 may be formed in other configurations. Further, the configuration of the arced portion 92 is not limited to the arc shape, and alternatively, may be formed in configurations other than the arced shape.

The disclosure is applicable to the variable valve timing control apparatus which changes a relative rotational phase by supplying the operation fluid between the partition portion of the driving side rotation member and the vane portion of the driven side rotation member.

According to the construction of the disclosure, a variable valve timing control apparatus includes a driving side rotation member (10) synchronously rotating with a crankshaft (1) of an internal combustion engine (E), a driven side rotation member (20) positioned coaxially with a rotational axis (X) of the driving side rotation member (10) and synchronously rotating with a camshaft (3) for opening and closing a valve for the internal combustion engine (E), at least one plate (4, 5) provided at a position facing at least one of surfaces of the driving side rotation member (10), the surfaces extending in a radial direction, a plurality of partition portions (12) extending inwardly from an outer peripheral inner portion (11) of the driving side rotation member (10) to form a fluid chamber between the partition portions (12), a vane portion (22) extending outwardly from an inner peripheral outer portion (21) of the driven side rotation member (20), the vane portion (22) being fitted to the fluid chamber to relatively rotate the driving side rotation member (10) and the driven side rotation member (20) within a movable range of the vane portion (22), a retarded angle chamber (R2) formed by dividing the fluid chamber by the vane portion (22) and configured to vary a relative rotational phase of the driven side rotation member (20) relative to the driving side rotation member (10) towards a retarded angle side, an advanced angle chamber (R1) formed by dividing the fluid chamber by the vane portion (22) and configured to vary the relative rotational phase of the driven side rotation member (20) relative to the driving side rotation member (10) towards an advanced angle side, a restriction mechanism (L) for restricting the relative rotational phase, the restriction mechanism (L) including a restriction member (31) configured to switch a restricted position, which is defined as a position at which a relative rotation between the driving side rotation member (10) and the driven side rotation member (20) is restricted at the relative rotational phase except a most retarded angle phase and a most advanced angle phase, and an unrestricted position at which the restriction is canceled, a fastening member (6) fixing the plate (4, 5) and the partition portion (12) of the driving side rotation member (10), and a reinforcement member (15) engaged with the partition portion (12) including a contact surface among the partition portions (12), the contact surface being configured to receive a contact of the vane portion (22) when the relative rotational phase is either at the most retarded angle phase or the most advanced angle phase.

According to the disclosure, because the driving side rotation member (outer rotor 10) includes the plural partition portions (12) which protrude inwardly from the outer peripheral inner portion (outer shell portion 11), the position of the partition portion is displaced, or changed when the vane portion (22) comes in contact with the partition portion (12). The restriction mechanism (lock mechanism L) restricts the relative rotation of the driving side rotation member (outer rotor 10) relative to the driven side rotation member (inner rotor 20) at a relative rotational phase within a movable range of the vane portion (22) except the most retarded angle phase and the most advanced angle phase. In a case where the restriction by the restriction mechanism (lock mechanism L) is canceled at the start of the internal combustion engine to vary the relative rotational phase towards the most retarded angle, the vane portion (22) may come in contact with the partition portion (12) with strong force because a distance of the vane portion (22) relative to the partition portion (12) at the retarded angle side is relatively large when the restriction by the restriction mechanism (lock mechanism L) is canceled and almost no operation fluid is left in the retarded angle chamber (R2). The phenomenon that the vane portion (22) comes in contact with the partition portion (12) with strong force is caused by the urging force, or reactive force acting on the driven side rotation member (inner rotor 20) in response to the rotation of the crankshaft, and the vane portion (22) comes in contact with the partition portion (12) repeatedly. In response to the foregoing drawback, according to the construction of the disclosure, even in a state where the vane portion (22) comes in contact with the partition portion (12) with strong force, the reinforcement member (15) receives the force acting on the partition portion (12) and then transmits the force to the plate, thus the deformation of the partition portion (12) is restrained. Thus, by restraining the deformation of the partition portion (12) of the variable valve timing control apparatus which controls the vane portion (22) of the driven side rotation member (inner rotor 20) to contact relative to the partition portion (12) of the driving side rotation member (outer rotor 10), a variable valve timing control apparatus which performs an appropriate control can be attained.

According to the construction of the embodiment, a distance from the rotational axis (X) to the reinforcement member (15) in a radial direction is shorter than a distance from the rotational axis (X) to the fastening member (6) in a radial direction.

According to the construction of the disclosure, because the driving side rotation member (outer rotor 10) includes the plural partition portions (12) which protrude inwardly from the outer periphery inner portion (body portion 21), in a case where the vane portion (22) comes in contact with the partition portion (12), a protrusion end of the partition portion (an end portion which is close to the rotational axis (X)) displaces largely. Accordingly, by positioning the reinforcement member (15) which engages with the plate (4, 5) and the partition portion (12) at a position close to the rotational axis (X) with reference to the position of the fastening member (connection bolt 6), even if the vane portion (22) comes in contact with the partition portion (12) with large force, the reinforcement member (15) receives the force acting on the partition portion (12) and then transmits the force to the plate, thus the deformation of the partition portion (12) is restrained.

According to a construction of the embodiment, each of the plate (4) and the partition portion (12) are formed with an engagement hole (4A, 12A) which is arranged in parallel with the rotational axis (X), and the reinforcement member (15) is formed in a pin shape to be engaged with each of the engagement holes.

According to the construction of the disclosure, the engagement hole (4A, 12A) is formed at each of the plate (4) and the partition portion (12). A pin shaped reinforcement member (15) which engages with the engagement holes (4A, 12A) (engages extending over the engagement holes (4A, 12A) is applied. In those circumstances, for example, the plate (4) and the partition portion (12) can be integrally formed by adopting a process for providing (e.g., driving, or hammering) the reinforcement member (15) into the engagement hole (4A, 12A), the relative displacement of the plate (4) and the partition portion (12) can be restrained.

According to the construction of the embodiment, the plates serving as a pair are provided to sandwich the driving side rotation member (10) and the driven side rotation member (20) in a direction along the rotational axis (X), the plates are fixed to the partition portion (12) by the fastening member (6), each of the plates (4, 5) and the partition portion (12) are formed with an engagement hole (4A, 5A, 12A) which is arranged in parallel with the rotational axis (X), and the reinforcement member (15) is formed in a pin shape to be engaged with each of the engagement holes (4A, 5A, 12A).

According to the construction of the disclosure, by forming the engagement holes (4A, 12A, 5A) through one of the plates (4), the partition portion (12), and the other of the plates (5) and by adopting a process for providing (e.g., driving, or hammering) the pin shaped reinforcement member (15) into the engagement holes (4A, 12A, 5A), the plates serving as a pair and the partition portion (12) are integrally formed thus to restrain the relative displacement of the plates (4, 5) and the partition portion (12). Particularly, according to the construction in which a sprocket portion, for example, is formed at an outer periphery of one of the plates serving as a pair and a driving force from a crankshaft is transmitted to the sprocket portion, for example, because the plates (4, 5) and the partition portion (12) to which the driving force is transmitted are integrally formed with the reinforcement member (15), a relative displacement of the plates and the partition portion (12) is restrained to securely transmit the driving force from the crankshaft to the partition portion (12).

According to the construction of the embodiment, a variable valve timing control apparatus includes a driving side rotation member (10) synchronously rotating with a crankshaft (1) of an internal combustion engine (E), a driven side rotation member (20) positioned coaxially with a rotational axis (X) of the driving side rotation member (10) and synchronously rotating with a camshaft (3) for opening and closing a valve for the internal combustion engine (E), at least one plate (4, 5) provided at a position facing at least one of surfaces of the driving side rotation member (10), the surfaces extending in a radial direction, a plurality of partition portions (12) extending inwardly from an outer peripheral inner portion (11) of the driving side rotation member (10) to form a fluid chamber between the partition portions (12), a vane portion (22) extending outwardly from an inner peripheral outer portion (21) of the driven side rotation member (20), the vane portion (22) being fitted to the fluid chamber to relatively rotate the driving side rotation member (10) and the driven side rotation member (20) within a movable range of the vane portion (22), a retarded angle chamber (R2) formed by dividing the fluid chamber by the vane portion (22) and configured to vary a relative rotational phase of the driven side rotation member (20) relative to the driving side rotation member (10) towards a retarded angle side, an advanced angle chamber (R1) formed by dividing the fluid chamber by the vane portion (22) and configured to vary the relative rotational phase of the driven side rotation member (20) relative to the driving side rotation member (10) towards an advanced angle side, a restriction mechanism (L) for restricting the relative rotational phase, the restriction mechanism (L) including a restriction member (31) configured to switch a restricted position, which is defined as a position at which a relative rotation between the driving side rotation member (10) and the driven side rotation member (20) is restricted at the relative rotational phase except a most retarded angle phase and a most advanced angle phase, and an unrestricted position at which the restriction is canceled, a fastening member (6) fixing the plate (4, 5) and the partition portion (12) of the driving side rotation member (10), and a protection member (91) provided in at least one of the retarded angle chambers (R2) and in at least one of the advanced angle chambers (R1), the protection member (91) with which the vane portion (22) comes in contact when the relative rotational phase is at the most retarded angle phase or at the most advanced angle phase.

According to the construction of the disclosure, because the vane portion (22) does not come in contact with the partition portion (12), the deformation of the partition portion (12) can be eliminated. Thus, by restraining the deformation of the partition portion (12) of the variable valve timing control apparatus, the variable valve timing control apparatus which performs an appropriate control can be attained.

According to the construction of the disclosure, the protection member (91) is formed in a columnar configuration whose axis is in parallel with the rotational axis (X), and the vane portion (22) is formed with an arced portion (92) at a surface facing the protection member (91), the arced portion (92) having a curvature smaller than a curvature of an outer peripheral surface of the protection member (91) and being configured to accommodate at least a portion of the protection member (91).

According to the construction of the disclosure, because the vane portion (22) can be rotated to the position at which the vane portion (22) accommodates the protection member (91), a greater rotation range of the vane portion (22) can be ensured. Further, according to the construction of the disclosure, an amount of the operation fluid which is reserved at an end portion of the fluid chamber when the vane portion (22) reaches the most advanced angle position or the most retarded angle portion can be reduced. Thus, responsivity can be enhanced.

According to the construction of the embodiment, the protection member (91) is provided in each of the retarded angle chamber (R2) and the advanced angle chamber (R1) in the same fluid chamber.

According to the construction of the disclosure, the protection members (91) can be provided in a manner sandwiching the single vane portion (22). Thus, in case of reinforcing the vane portion (22) which is configured to contact the protection member (91), only vane member (22) needs to be reinforced, thus a structure can be simplified.

According to the construction of the embodiment, a distance from the rotational axis (X) to the protection member (91) in a radial direction is shorter than a distance from the rotational axis (X) to the fastening member (6) in a radial direction.

According to the construction of the disclosure, because the driving side rotation member (outer rotor 10) includes the plural partition portions (12) which protrude inwardly from the outer periphery inner portion (body portion 21), in a case where the vane portion (22) comes in contact with the partition portion (12), a protrusion end of the partition portion (an end portion which is close to the rotational axis (X)) displaces largely. Accordingly, by positioning the protection member (91) which engages with the plate (4, 5) and the partition portion (12) at a position close to the rotational axis (X) with reference to the position of the fastening member (connection bolt 6), even if the vane portion (22) comes in contact with the partition portion (12) with large force, the protection member (91) receives the force acting on the partition portion (12) and then transmits the force to the plate, thus the deformation of the partition portion (12) is restrained.

According to the construction of the embodiment, a variable valve timing control apparatus includes a driving side rotation member (10) synchronously rotating with a crankshaft (1) of an internal combustion engine (E), a driven side rotation member (20) positioned coaxially with a rotational axis (X) of the driving side rotation member (10) and synchronously rotating with a camshaft (3) for opening and closing a valve for the internal combustion engine (E), a plate (4, 5) provided at a position facing at least one of surfaces of the driving side rotation member (10), the surfaces extending in a radial direction, a plurality of partition portions (12) extending inwardly from an outer peripheral inner portion (11) of the driving side rotation member (10) to form a fluid chamber between the partition portions, a vane portion (22) extending outwardly from an inner peripheral outer portion (21) of the driven side rotation member (20), the vane portion (22) being fitted to the fluid chamber to relatively rotate the driving side rotation member (10) and the driven side rotation member (20) within a movable range of the vane portion (22), a retarded angle chamber (R2) formed by dividing the fluid chamber by the vane portion (22) and configured to vary a relative rotational phase of the driven side rotation member (20) relative to the driving side rotation member (10) towards a retarded angle side, an advanced angle chamber (R1) formed by dividing the fluid chamber by the vane portion (22) and configured to vary the relative rotational phase of the driven side rotation member (20) relative to the driving side rotation member (10) towards an advanced angle side, a fastening member (6) fixing the plate (4, 5) to the partition portion (12) of the driving side rotation member (10), and a reinforcement member (15) engaged with the partition portion (12) including a contact surface among the partition portions (12), the contact surface being configured to receive a contact of the vane portion (22) when the relative rotational phase is either at a most retarded angle phase or a most advanced angle phase, the reinforcement member (15) being engaged with the partition portion (12) at a position having a distance from the rotational axis (X) which is shorter than a distance from the rotational axis (X) to the fastening member (6).

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control apparatus, comprising:

a driving side rotation member synchronously rotating with a crankshaft of an internal combustion engine;

a driven side rotation member positioned coaxially with a rotational axis of the driving side rotation member and synchronously rotating with a camshaft for opening and closing a valve for the internal combustion engine;

at least one plate provided at a position facing at least one of surfaces of the driving side rotation member, the surfaces extending in a radial direction;

a plurality of partition portions extending inwardly from an outer peripheral inner portion of the driving side rotation member to form a fluid chamber between the partition portions;

a vane portion extending outwardly from an inner peripheral outer portion of the driven side rotation member, the vane portion being fitted to the fluid chamber to relatively rotate the driving side rotation member and the driven side rotation member within a movable range of the vane portion;

a retarded angle chamber formed by dividing the fluid chamber by the vane portion and configured to vary a relative rotational phase of the driven side rotation member relative to the driving side rotation member towards a retarded angle side;

an advanced angle chamber formed by dividing the fluid chamber by the vane portion and configured to vary the relative rotational phase of the driven side rotation member relative to the driving side rotation member towards an advanced angle side;

a restriction mechanism for restricting the relative rotational phase, the restriction mechanism including a restriction member configured to switch a restricted position, which is defined as a position at which a relative rotation between the driving side rotation member and the driven side rotation member is restricted at the relative rotational phase except a most retarded angle phase and a most advanced angle phase, and an unrestricted position at which the restriction is canceled;

a fastening member fixing the plate and the partition portion of the driving side rotation member; and a reinforcement member engaged with the partition portion including a contact surface among the partition portions, the contact surface being configured to receive a contact of the vane portion when the relative rotational phase is either at the most retarded angle phase or the most advanced angle phase.

2. The variable valve timing control apparatus according to claim 1, wherein a distance from the rotational axis to the reinforcement member in a radial direction is shorter than a distance from the rotational axis to the fastening member in a radial direction.

3. The variable valve timing control apparatus according to claim 1, wherein each of the plate and the partition portion are formed with an engagement hole which is arranged in parallel with the rotational axis, and the reinforcement member is formed in a pin shape to be engaged with each of the engagement holes.

4. The variable valve timing control apparatus according to claim 2, wherein each of the plate and the partition portion are formed with an engagement hole which is arranged in parallel with the rotational axis, and the reinforcement member is formed in a pin shape to be engaged with each of the engagement holes.

5. The variable valve timing control apparatus according to claim 1, wherein the plates serving as a pair are provided to sandwich the driving side rotation member and the driven side rotation member in a direction along the rotational axis;

the plates are fixed to the partition portion by the fastening member;

each of the plates and the partition portion are formed with an engagement hole which is arranged in parallel with the rotational axis; and the reinforcement member is formed in a pin shape to be engaged with each of the engagement holes.

6. The variable valve timing control apparatus according to claim 2, wherein the plates serving as a pair are provided to sandwich the driving side rotation member and the driven side rotation member in a direction along the rotational axis;

the plates are fixed to the partition portion by the fastening member;

each of the plates and the partition portion are formed with an engagement hole which is arranged in parallel with the rotational axis; and the reinforcement member is formed in a pin shape to be engaged with each of the engagement holes.

7. A variable valve timing control apparatus, comprising:

a driving side rotation member synchronously rotating with a crankshaft of an internal combustion engine;

a driven side rotation member positioned coaxially with a rotational axis of the driving side rotation member and synchronously rotating with a camshaft for opening and closing a valve for the internal combustion engine;

at least one plate provided at a position facing at least one of surfaces of the driving side rotation member, the surfaces extending in a radial direction;

a plurality of partition portions extending inwardly from an outer peripheral inner portion of the driving side rotation member to form a fluid chamber between the partition portions;

a vane portion extending outwardly from an inner peripheral outer portion of the driven side rotation member, the vane portion being fitted to the fluid chamber to relatively rotate the driving side rotation member and the driven side rotation member within a movable range of the vane portion;

a retarded angle chamber formed by dividing the fluid chamber by the vane portion and configured to vary a relative rotational phase of the driven side rotation member relative to the driving side rotation member towards a retarded angle side;

an advanced angle chamber formed by dividing the fluid chamber by the vane portion and configured to vary the relative rotational phase of the driven side rotation member relative to the driving side rotation member towards an advanced angle side;

a restriction mechanism for restricting the relative rotational phase, the restriction mechanism including a restriction member configured to switch a restricted position, which is defined as a position at which a relative rotation between the driving side rotation member and the driven side rotation member is restricted at the relative rotational phase except a most retarded angle phase and a most advanced angle phase, and an unrestricted position at which the restriction is canceled;

a fastening member fixing the plate and the partition portion of the driving side rotation member; and a protection member provided in at least one of the retarded angle chambers and in at least one of the advanced angle chambers, the protection member with which the vane portion comes in contact when the relative rotational phase is at the most retarded angle phase or at the most advanced angle phase, wherein the protection member is formed in a columnar configuration whose axis is in parallel with the rotational axis; and the vane portion is formed with an arced portion at a surface facing the protection member, the arced portion having a curvature smaller than a curvature of an outer peripheral surface of the protection member and being configured to accommodate at least a portion of the protection member.

8. The variable valve timing control apparatus according to claim 7, wherein the protection member is provided in each of the retarded angle chamber and the advanced angle chamber in the same fluid chamber.

9. The variable valve timing control apparatus according to claim 7, wherein a distance from the rotational axis to the protection member in a radial direction is shorter than a distance from the rotational axis to the fastening member in a radial direction.

10. The variable valve timing control apparatus according to claim 8, wherein a distance from the rotational axis to the protection member in a radial direction is shorter than a distance from the rotational axis to the fastening member in a radial direction.

11. A variable valve timing control apparatus, comprising:

a driving side rotation member synchronously rotating with a crankshaft of an internal combustion engine;

a driven side rotation member positioned coaxially with a rotational axis of the driving side rotation member and synchronously rotating with a camshaft for opening and closing a valve for the internal combustion engine;

a plate provided at a position facing at least one of surfaces of the driving side rotation member, the surfaces extending in a radial direction;

a plurality of partition portions extending inwardly from an outer peripheral inner portion of the driving side rotation member to form a fluid chamber between the partition portions;

a vane portion extending outwardly from an inner peripheral outer portion of the driven side rotation member, the vane portion being fitted to the fluid chamber to relatively rotate the driving side rotation member and the driven side rotation member within a movable range of the vane portion;

a retarded angle chamber formed by dividing the fluid chamber by the vane portion and configured to vary a relative rotational phase of the driven side rotation member relative to the driving side rotation member towards a retarded angle side;

an advanced angle chamber formed by dividing the fluid chamber by the vane portion and configured to vary the relative rotational phase of the driven side rotation member relative to the driving side rotation member towards an advanced angle side;

a fastening member fixing the plate to the partition portion of the driving side rotation member; and a reinforcement member engaged with the partition portion including a contact surface among the partition portions, the contact surface being configured to receive a contact of the vane portion when the relative rotational phase is either at a most retarded angle phase or a most advanced angle phase, the reinforcement member being engaged with the partition portion at a position having a distance from the rotational axis which is shorter than a distance from the rotational axis to the fastening member.

12. A variable valve timing control apparatus, comprising:

a driving side rotation member synchronously rotating with a crankshaft of an internal combustion engine;

a driven side rotation member positioned coaxially with a rotational axis of the driving side rotation member and synchronously rotating with a camshaft for opening and closing a valve for the internal combustion engine;

at least one plate provided at a position facing at least one of surfaces of the driving side rotation member, the surfaces extending in a radial direction;

a plurality of partition portions extending inwardly from an outer peripheral inner portion of the driving side rotation member to form a fluid chamber between the partition portions;

a vane portion extending outwardly from an inner peripheral outer portion of the driven side rotation member, the vane portion being fitted to the fluid chamber to relatively rotate the driving side rotation member and the driven side rotation member within a movable range of the vane portion;

a retarded angle chamber formed by dividing the fluid chamber by the vane portion and configured to vary a relative rotational phase of the driven side rotation member relative to the driving side rotation member towards a retarded angle side;

an advanced angle chamber formed by dividing the fluid chamber by the vane portion and configured to vary the relative rotational phase of the driven side rotation member relative to the driving side rotation member towards an advanced angle side;

a restriction mechanism for restricting the relative rotational phase, the restriction mechanism including a restriction member configured to switch a restricted position, which is defined as a position at which a relative rotation between the driving side rotation member and the driven side rotation member is restricted at the relative rotational phase except a most retarded angle phase and a most advanced angle phase, and an unrestricted position at which the restriction is canceled;

a fastening member fixing the plate and the partition portion of the driving side rotation member, the fastening member having a central axis;

a protection member provided in at least one of the retarded angle chambers and in at least one of the advanced angle chambers, the vane portion coming in contact with the protection member when the relative rotational phase is at the most retarded angle phase or at the most advanced angle phase;

the protection member possessing a columnar configuration whose axis is parallel to the rotational axis;

a distance from the rotational axis to the axis of the protection member being shorter than a distance from the rotational axis to the central axis of the fastening member in the radial direction; and a recessed portion provided at the partition portion, the recessed portion being recessed in a rotational direction of the rotational axis, the recessed portion accommodating the protection member.

* * * * *